US011380279B2

(12) United States Patent
Chen et al.

(10) Patent No.: US 11,380,279 B2
(45) Date of Patent: Jul. 5, 2022

(54) LIQUID CRYSTAL DISPLAY DEVICE AND DRIVING METHOD COMPENSATING GRAYSCALE DATA VOLTAGES TO OFFSET VOLTAGES OF COMMON ELECTRODE (VCOM) SHIFT

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Zejun Chen, Beijing (CN); Jianjun Wang, Beijing (CN); Xiaoshi Liu, Beijing (CN); Min Wang, Beijing (CN); Hui Dong, Beijing (CN)

(73) Assignees: HEFEI XINSHENG OPTOELECTRONICS TECHNOLOGY CO., LTD, Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 797 days.

(21) Appl. No.: 16/315,331

(22) PCT Filed: Jun. 11, 2018

(86) PCT No.: PCT/CN2018/090591
§ 371 (c)(1),
(2) Date: Jan. 4, 2019

(87) PCT Pub. No.: WO2019/062203
PCT Pub. Date: Apr. 4, 2019

(65) Prior Publication Data

US 2021/0358443 A1 Nov. 18, 2021

(30) Foreign Application Priority Data

Sep. 27, 2017 (CN) ..... 201710891602.4

(51) Int. Cl.
*G09G 3/36* (2006.01)

(52) U.S. Cl.
CPC ..... *G09G 3/3688* (2013.01); *G09G 2310/027* (2013.01); *G09G 2310/0289* (2013.01)

(58) Field of Classification Search
CPC ..... G09G 3/36; G09G 3/3611; G09G 3/3614; G09G 3/3622; G09G 3/3625; G09G 3/364;
(Continued)

(56) References Cited

U.S. PATENT DOCUMENTS

2006/0132415 A1* 6/2006 Yu ..... G09G 3/3655 345/98
2010/0033414 A1* 2/2010 Jeong ..... G09G 3/3655 345/89
(Continued)

FOREIGN PATENT DOCUMENTS

CN 101383128 A 3/2009
CN 104347048 A 2/2015
(Continued)

OTHER PUBLICATIONS

International Search Report dated Aug. 31, 2018, issued in counterpart Application No. PCT/CN2018/090591. (13 pages).
(Continued)

*Primary Examiner* — Alexander Eisen
*Assistant Examiner* — Nelson Lam
(74) *Attorney, Agent, or Firm* — WHDA, LLP

(57) ABSTRACT

The present disclosure is related to a display driving method. The display driving method may include obtaining a grayscale data voltage compensation table; calculating a value of VCOM shift amplitude corresponding to a row of sub-pixels on a display panel based on grayscale data voltages of a frame of an image to be displayed; obtaining a grayscale data voltage compensation value corresponding to the row of sub-pixels on the display panel based on the calculated value of VCOM shift amplitude and the grayscale data voltage compensation table; compensating grayscale data voltages actually inputted to the row of sub-pixels based on the grayscale data voltage compensation value to obtain compensated grayscale data voltages; and outputting the compensated grayscale data voltages to the row of sub-pixels during a display time of the frame of the image to be displayed.

11 Claims, 4 Drawing Sheets

(58) Field of Classification Search
CPC .. G09G 3/3655; G09G 3/3674; G09G 3/3677; G09G 3/3681; G09G 3/3685; G09G 3/3688; G09G 3/3692; G09G 2310/027
USPC ..... 345/87–104
See application file for complete search history.

(56) References Cited

U.S. PATENT DOCUMENTS

| | | | | |
|---|---|---|---|---|
| 2011/0109662 | A1* | 5/2011 | Cho | G09G 3/3688 345/690 |
| 2012/0249620 | A1* | 10/2012 | Choi | G09G 3/3688 345/694 |
| 2013/0106925 | A1* | 5/2013 | Sasaki | G02F 1/13306 345/690 |
| 2015/0187291 | A1* | 7/2015 | Jang | G09G 3/3611 345/694 |
| 2018/0350283 | A1* | 12/2018 | Jiang | G09G 3/006 |
| 2021/0264865 | A1* | 8/2021 | Qiu | G09G 3/3607 |

FOREIGN PATENT DOCUMENTS

| | | | |
|---|---|---|---|
| CN | 104571701 | A | 4/2015 |
| CN | 105529011 | A | 4/2016 |
| CN | 106205523 | A | 12/2016 |
| CN | 106710504 | A | 5/2017 |
| CN | 106782397 | A | 5/2017 |
| CN | 107464541 | A | 12/2017 |
| KR | 20040013536 | A | 2/2004 |
| KR | 101461018 | B1 | 11/2014 |

OTHER PUBLICATIONS

Office Action dated Mar. 21, 2019, issued in counterpart CN Application No. 2017108916024, with English translation (24 pages).

* cited by examiner

LIQUID CRYSTAL DISPLAY DEVICE AND DRIVING METHOD COMPENSATING GRAYSCALE DATA VOLTAGES TO OFFSET VOLTAGES OF COMMON ELECTRODE (VCOM) SHIFT

CROSS-REFERENCE TO RELATED APPLICATIONS

This application claims benefit of the filing date of Chinese Patent Application No. 201710891602.4 filed on Sep. 27, 2017, the disclosure of which is hereby incorporated in its entirety by reference.

TECHNICAL FIELD

This disclosure relates to a display technology, in particular, to a display driving apparatus, a driving method thereof, and a display assembly.

BACKGROUND

When a thin film transistor liquid crystal display (TFT-LCD) apparatus displays certain specific patterns, due to uneven distribution of positive and negative polarity, voltages of common electrodes (VCOM) are shifted in a certain direction. As such, display shortcomings such as color shift and line image sticking are generated.

BRIEF SUMMARY

Accordingly, one example of the present is a display driving method. The display driving method may include obtaining a grayscale data voltage compensation table, wherein the grayscale data voltage compensation table stores mapping relationship between values of VCOM shift amplitude and grayscale data voltage compensation values; calculating a value of VCOM shift amplitude corresponding to a row of sub-pixels on a display panel based on grayscale data voltages of a frame of an image to be displayed; obtaining a grayscale data voltage compensation value corresponding to the row of sub-pixels on the display panel based on the calculated value of VCOM shift amplitude and the grayscale data voltage compensation table; compensating grayscale data voltages actually inputted to the row of sub-pixels based on the grayscale data voltage compensation value to obtain compensated grayscale data voltages; and outputting the compensated grayscale data voltages to the row of sub-pixels during a display time of the frame of the image to be displayed.

Calculating the value of VCOM shift amplitude corresponding to the row of sub-pixels on the display panel based on grayscale data voltages of the frame of an image to be displayed may include acquiring a plurality of grayscale data voltages respectively corresponding to a plurality of sub-pixels in the row of sub-pixels among grayscale data voltages of the frame of the image to be displayed, each of the plurality of the grayscale data voltages corresponding to a sub-pixel of the row of the sub-pixels; obtaining a first shift value by adding the grayscale data voltages of positive polarity among the plurality of grayscale data voltages respectively corresponding to the plurality of sub-pixels in the row of sub-pixels; obtaining a second shift value by adding absolute values of the grayscale data voltages of negative polarity among the plurality of grayscale data voltages respectively corresponding to the plurality of sub-pixels in the row of sub-pixels; and obtaining the value of VCOM shift amplitude by subtracting the second shift value from the first shift value.

Before obtaining the grayscale data voltage compensation table, the display driving method may further include obtaining an initial grayscale data voltage compensation table, wherein the initial grayscale data voltage compensation table stores mapping relationship between values of initial VCOM shift amplitude and initial grayscale data voltage compensation values; providing initial grayscale data voltages to a row of sub-pixels on a display panel so that a value of VCOM shift amplitude corresponding to the row of the sub-pixels is a value of initial VCOM shift amplitude corresponding to the row of the sub-pixels; compensating the grayscale data voltages actually inputted to the row of the sub-pixels based on an initial grayscale data voltage compensation value corresponding to the value of initial VCOM shift amplitude to obtain initial compensated grayscale data voltages; outputting the initial compensated grayscale data voltages to the row of the sub-pixels; measuring actual brightness values of the row of sub-pixels; and adjusting the initial compensated grayscale data voltages based on difference between the actual brightness values and preset brightness values of the row of sub-pixels to obtain the grayscale data voltage compensation value corresponding to the value of initial VCOM shift amplitude, thereby obtaining the grayscale data voltage compensation table. The preset brightness values are theoretical values of brightness of the row of sub-pixels when the initial grayscale data voltages are provided to the row of the sub-pixels. The grayscale data voltages actually inputted to the row of sub-pixels may include M grayscale data voltages, and each of the M grayscale data voltages may correspond to a sub-pixel in the row of the sub-pixels, and M is an integer larger than 1.

Compensating grayscale data voltages actually inputted to the row of sub-pixels based on the grayscale data voltage compensation value to obtain compensated grayscale data voltages may include controlling a grayscale data voltage actually inputted to a sub-pixel of the row of sub-pixels to be equal to a sum of an original grayscale data voltage of the sub-pixel and the grayscale data voltage compensation value.

Another embodiment of the present disclosure is a display driving apparatus. The display driving apparatus may include a compensation table acquirer, a calculator, a compensation value acquirer, a compensator, and a grayscale data voltage outputer. The compensation table acquirer may be configured to acquire a grayscale data voltage compensation table, wherein the grayscale data voltage compensation table stores mapping relationship between values of VCOM shift amplitudes and grayscale data voltage compensation values. The calculator may be configured to calculate a value of VCOM shift amplitude corresponding to a row of sub-pixels on the display panel based on grayscale data voltages of a frame of image to be displayed. The compensation value acquirer may be coupled to the compensation table acquirer and the calculator and configured to obtain a grayscale data voltage compensation value corresponding to the row of sub-pixels on the display panel based on the calculated value of VCOM shift amplitude and the grayscale data voltage compensation table. The compensator may be coupled to the compensation value acquirer and configured to compensate the grayscale data voltages actually inputted to the row of sub-pixels based on the grayscale data voltage compensation value to obtain compensated grayscale data voltages. The grayscale data voltage outputer may be coupled to the compensator and configured to output the compensated grayscale data voltages to the row of sub-pixels during display time of the frame of image to be displayed.

The calculator may include a grayscale data voltage acquirer, a first calculator, a second calculator, and a third calculator. The grayscale data voltage acquirer may be configured to acquire a plurality of grayscale data voltages respectively corresponding to a plurality of sub-pixels of the row of sub-pixels among the grayscale data voltages of the frame of image to be displayed. Each of the grayscale data voltages may correspond to a sub-pixel of the row of sub-pixels. A first calculator may be coupled to the grayscale data voltage acquirer and configured to add the grayscale data voltages of positive polarity among the plurality of grayscale data voltages to obtain a first shift value. A second calculator may be coupled to the grayscale data voltage acquirer and configured to add absolute values of the grayscale data voltages of negative polarity among the plurality of grayscale data voltages to obtain a second shift value. A third calculator may be coupled to the first calculator and the second calculator and configured to subtract the second shift value from the first shift value to obtain the value of VCOM shift amplitude.

The display driving apparatus may further include a compensation table checker. The compensation table checker may include an initial acquirer, an initial compensator, and a compensation table detector. The initial acquirer may be configured to acquire an initial grayscale data voltage compensation table, wherein the initial grayscale data voltage compensation table stores mapping relationship between values of initial VCOM shift amplitude and initial grayscale data voltage compensation values. The initial compensator may be coupled to the initial acquirer and configured to provide initial grayscale data voltages to a row of sub-pixels on a display panel so that a value of VCOM shift amplitude corresponding to the row of the sub-pixels is a value of initial VCOM shift amplitude corresponding to the row of the sub-pixels, to compensate the grayscale data voltages actually inputted to the row of the sub-pixels based on the initial grayscale data voltage compensation value corresponding to the value of initial VCOM shift amplitude to obtain initial compensated grayscale data voltages; and to output the initial compensated grayscale data voltages to the row of the sub-pixels. The compensation table detector may be respectively coupled to the initial acquirer and the compensation table acquirer, and configured to measure actual brightness values of the row of sub-pixels and to adjust the initial compensated grayscale data voltages based on difference between the actual brightness values and preset brightness values of the row of sub-pixels to obtain the grayscale data voltage compensation value corresponding to the value of initial VCOM shift amplitude, thereby obtaining the grayscale data voltage compensation table. The preset brightness values are theoretical values of brightness of the plurality of sub-pixels when the initial grayscale data voltages are provided to the row of the sub-pixels.

The grayscale data voltages actually inputted to the row of sub-pixels may include M grayscale data voltages, and each of the M grayscale data voltages may correspond to a sub-pixel in the row of the sub-pixels, and M is an integer larger than 1. The compensator maybe configured to control a grayscale data voltage actually inputted to a sub-pixel of the row of sub-pixels to be equal to a sum of an original grayscale data voltage of the sub-pixel and the grayscale data voltage compensation value.

Another example of the present disclosure is a display assembly. The display assembly may include the display driving apparatus according to one embodiment of the present disclosure. The display assembly may further include a TCON. The compensation table acquirer, the calculator, the compensation value acquirer, the compensator, and the grayscale data voltage outputer may be all arranged on the TCON. The values of VCOM shift amplitudes may be divided into a plurality of groups, and each of the plurality of groups may correspond to a grayscale data voltage compensation value.

BRIEF DESCRIPTION OF THE DRAWINGS

The subject matter which is regarded as the disclosure is particularly pointed out and distinctly claimed in the claims at the conclusion of the specification. The foregoing and other objects, features, and advantages of the are apparent from the following detailed description taken in conjunction with the accompanying drawings in which:

DETAILED DESCRIPTION

Figure 1:
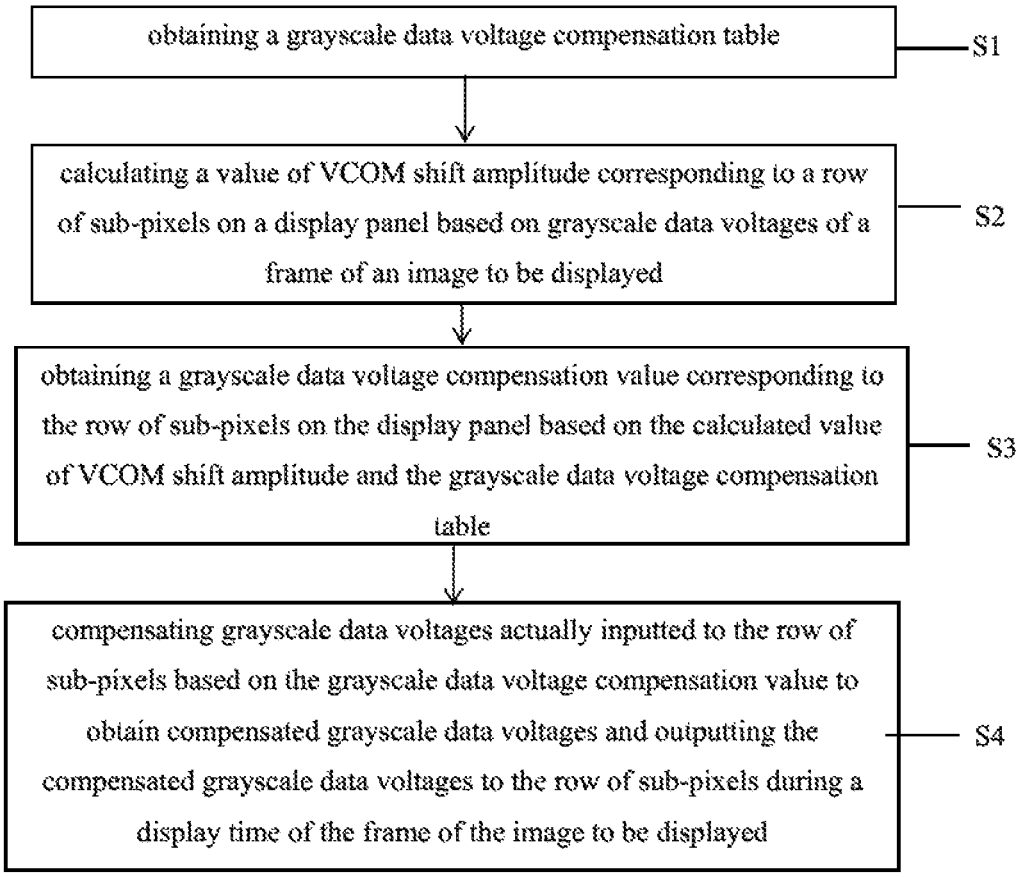
FIG. 1 is a flowchart of a display driving method according to some embodiments of the present disclosure.
Figure 2:
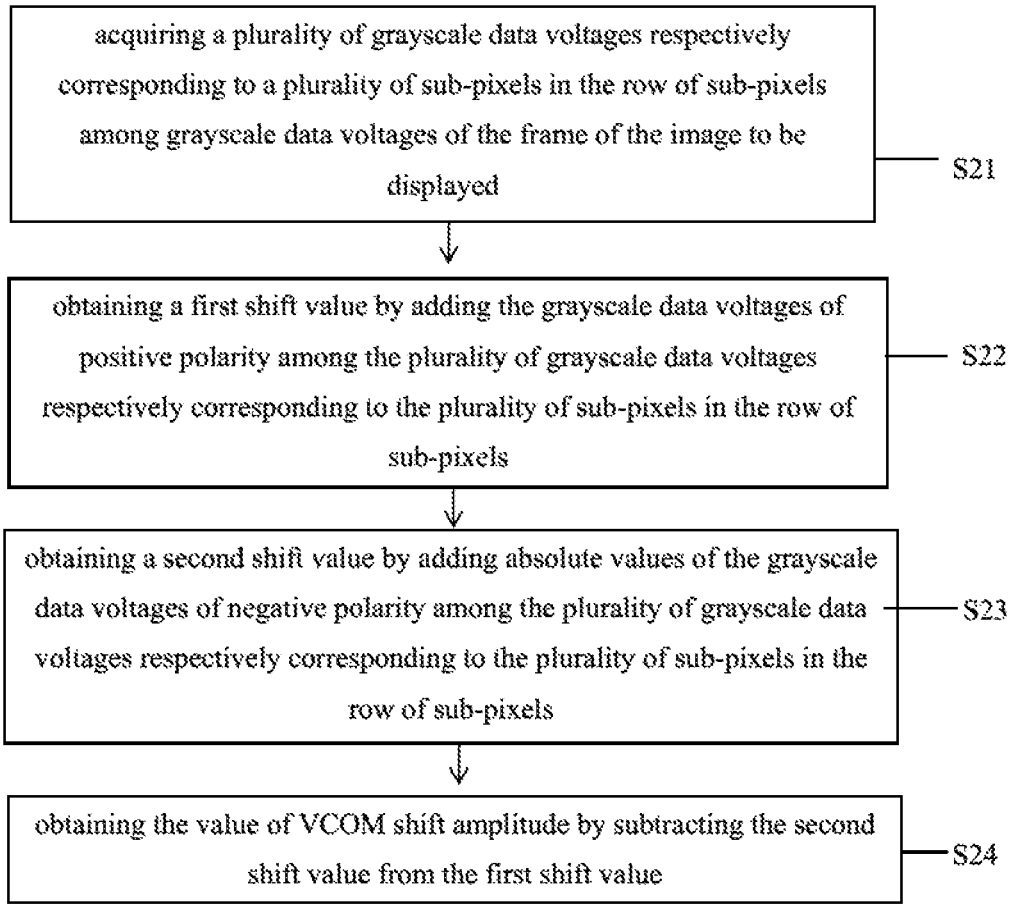
FIG. 2 is a flowchart of a step S2 of a display driving method according to some embodiments of the present disclosure.

The present disclosure will be described in further detail with reference to the accompanying drawings and embodiments in order to provide a better understanding by those skilled in the art of the technical solutions of the present disclosure. Throughout the description of the disclosure, reference is made to FIGS. 1-4. When referring to the figures, like structures and elements shown throughout are indicated with like reference numerals.

In the description of the specification, references made to the term "one embodiment," "some example embodiments," and "exemplary embodiments," "example," and "specific example," or "some examples" and the like are intended to refer that specific features and structures, materials or characteristics described in connection with the embodiment or example that are included in at least one embodiment or example of the present disclosure. The schematic expression of the terms does not necessarily refer to the same embodiment or example. Moreover, the specific features, structures, materials or characteristics described may be included in any suitable manner in any one or more embodiments or examples.

In the related art, the main method for solving the VCOM shift is to feed back the value of VCOM shift amplitude from a panel, input the value of VCOM shift amplitude to a driving circuit board which is used as an input terminal of a reverse amplifier, and, after processing, input the value of VCOM shift amplitude to the display panel, thereby achieving the effect of reducing the VCOM shift. The disadvantage of this method is that, due to existence of RC delay, the VCOM cannot be compensated in real time by using an external circuit to carrying out reverse compensation. In addition, when the characteristic of the panel is poor, the VCOM shift of the middle region cannot be compensated by this way. As such, poor phenomena such as color shift or the like cannot be effectively reduced.

A display driving method is provided according to some embodiments of the present disclosure. As shown in FIG. 1, the display driving method includes:

In step S1, a grayscale data voltage compensation table is acquired. The grayscale data voltage compensation table stores the mapping relationship between values of the VCOM shift amplitude and the grayscale data voltage compensation values.

In step S2, a value of VCOM shift amplitude corresponding to a row of sub-pixels on the display panel is calculated based on grayscale data voltages of a frame of an image to be displayed.

In step S3, based on the calculated value of the VCOM shift amplitude and the grayscale data voltage compensation table, a grayscale data voltage compensation value corresponding to a row of sub-pixels on the display panel is obtained.

In step S4, based on the grayscale data voltage compensation value, grayscale data voltages actually inputted to the row of the sub-pixels are compensated to obtain compensated grayscale data voltages. Then, the compensated grayscale data voltages are outputted to the row of sub-pixels within the display time of the frame of image to be displayed including a period of time when the grayscale data voltages are provided to the row of sub-pixels.

In the display driving method according to the embodiments of the present disclosure, the value of the VCOM shift amplitude corresponding to a row of sub-pixels on the display panel is calculated based on the grayscale data voltages of a frame of an image to be displayed. Then, based on the value of the VCOM shift amplitude, the grayscale data voltages are compensated to offset the VCOM shift, thereby reducing poor phenomena such as color shift caused by the VCOM shift.

In some embodiments, the grayscale data voltage compensation table is generally stored in an external memory. In some embodiments, it can also be stored in a memory built in a Time Controller (TCON) during actual operation.

In some embodiments, the processed data such as the grayscale data voltages and the like are digital signals.

In some embodiments, the value of VCOM shift amplitude can be calculated through the ICON to compensate the outputted grayscale data voltages. As such, the VCOM shift is offset, thereby reducing poor phenomena of color shift or the like caused by the VCOM shift.

The display driving method provided by the embodiments of the present disclosure starts from the signal sources provided by the grayscale data voltages, thereby avoiding the impact of RC delay (resistance delay). Furthermore, the influence of each sub-pixel in each row of sub-pixels on the VCOM is fully considered. The relationship between the values of VCOM shift amplitude and the gray-scale data voltage compensation values can be flexibly adjusted through TCON. As such, the display errors such as color shift can be eliminated.

In some embodiments, in step S2, calculating the value of the VCOM shift amplitude corresponding to a row of sub-pixels on the display panel based on the grayscale data voltages of a frame of an image to be displayed includes the followings:

In step S21, a plurality of grayscale data voltages respectively corresponding to a plurality of sub-pixels in a row of sub-pixels among the grayscale data voltages of the frame of the image to be displayed are acquired. Each of the plurality of the grayscale data voltages corresponds to one sub-pixel of the row of sub-pixels.

In step S22, the grayscale data voltages of positive polarity among the plurality of grayscale data voltages are added to obtain a first shift value.

In step S23, absolute values of the grayscale data voltages of negative polarity among the plurality of grayscale data voltages are added to obtain a second shift value.

In step S24, a value of a VCOM shift amplitude is obtained by subtracting the second shift value from the first shift value.

In some embodiments, the method of calculating the value of the VCOM shift amplitude includes adding the grayscale data voltages of positive polarity and the grayscale data voltages of negative polarity respectively corresponding to each of the sub-pixels in a same row.

In some other embodiments, a plurality of values of VCOM shift amplitude corresponds to one grayscale data voltage compensation value. The difference between two values of VCOM shift amplitudes corresponding to a same grayscale data voltage compensation value is smaller than a preset third value. The preset gray-scale data voltage compensation value can be adjusted based on the specific panel characteristics to achieve better compensation effect.

In some embodiments, the values of VCOM shift amplitude can be divided into a plurality of groups. Each group corresponds to one appropriate grayscale data voltage compensation value. As such, the amount of calculation in TCON can be reduced.

Specifically, before obtaining the grayscale data voltage compensation table, the display driving method can further include the following steps according to some embodiments of the present disclosure:

First, an initial grayscale data voltage compensation table is obtained. The initial grayscale data voltage compensation table stores the mapping relationship between values of initial VCOM shift amplitude and initial grayscale data voltage compensation values.

Then, initial grayscale data voltages are provided to a row of sub-pixels on the display panel, so that the value of the VCOM shift amplitude corresponding to the row of the sub-pixels is the value of the initial VCOM shift amplitude. The grayscale data voltages actually inputted to the row of the sub-pixels are compensated based on the initial grayscale data voltage compensation value to obtain initial compensated grayscale data voltages. The initial compensated grayscale data voltages are outputted to the row of the sub-pixels.

Then, an actual brightness value of each sub-pixel in the row of the sub-pixels is measured. Based on the difference between the actual brightness value and a preset brightness value, the initial grayscale data voltage compensation value is adjusted to obtain the grayscale data voltage compensation value corresponding to the value of the initial VCOM shift amplitude. As such, the grayscale data voltage compensation table is obtained. The preset brightness value is equal to a theoretical brightness value of the sub-pixel when each of the sub-pixels in the row of the sub-pixels is provided the initial grayscale data voltage.

In some embodiments, in order to obtain a grayscale data voltage compensation table, an initial grayscale data voltage compensation table is obtained first. Then, a row of sub-pixels on the display panel are controlled to correspond to the value of initial VCOM shift amplitudes, and the grayscale data voltages of the row of sub-pixels are initially compensated based on the corresponding initial gray scale data voltage compensation value. Then, the actual brightness values of the row of sub-pixels after the initial compensation are measured, and the initial grayscale data voltage compensation value is adjusted based on the difference between the actual brightness value and the theoretical brightness value of the row of sub-pixels to obtain the grayscale data voltage compensation table in S1.

In some embodiments, the grayscale data voltages actually inputted to the row of the sub-pixels include M grayscale data voltages. Each of the M grayscale data voltages corresponds to a sub-pixel in the row of the sub-pixels. M is an integer larger than 1.

Specifically, a row of sub-pixels includes a plurality of sub-pixels. Each of the sub-pixels is actually inputted with a grayscale data voltage.

In some embodiments, the step of compensating the grayscale data voltages actually inputted to the row of the sub-pixels based on the grayscale data voltage compensation value to obtain the compensated grayscale data voltages includes controlling a grayscale data voltage actually input into a sub-pixel of a row of sub-pixels to be equal to a sum of the original grayscale data voltage of the sub-pixel and the grayscale data voltage compensation value. The sum of the original grayscale data voltage of the sub-pixel and the grayscale data voltage compensation value refers to a voltage value obtained by adding the original grayscale data voltage and the grayscale data voltage compensation value.

In some embodiments, the original grayscale data voltage can be a value of positive or negative. The grayscale data voltage compensation value also has polarity. That is, the grayscale data voltage compensation value can be positive or negative. When the value of the VCOM shift amplitude is positive, the corresponding grayscale data voltage compensation value is positive. When the value of the VCOM shift amplitude is negative, the corresponding grayscale data voltage compensation value is negative.

The display driving method according to some embodiments of the present disclosure is described below. When a TFT-LCD displays certain specific patterns, due to uneven distribution of pixels of different polarities, the VCOMs are shifted and cannot be quickly recovered. The effect of VCOM shifting is that some of the sub-pixels become brighter and some of the sub-pixels become darker. A phenomenon of color shift can be observed by naked eyes. The embodiments will be further described below using an image display as an example.

Figure 3:
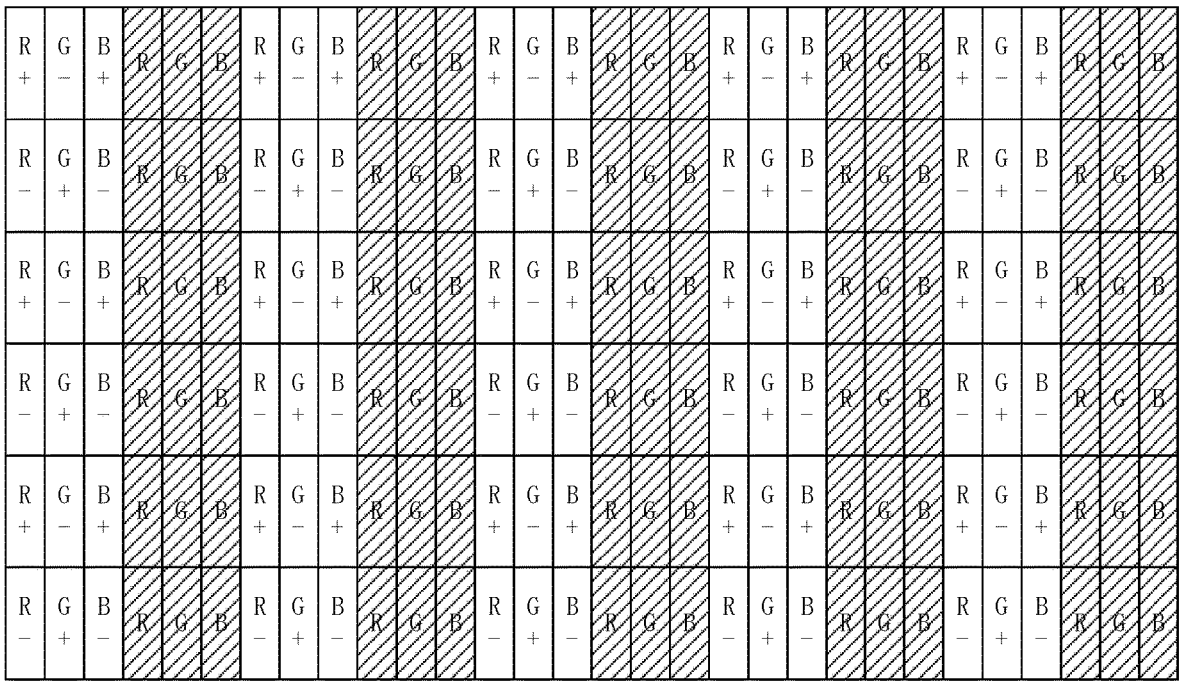
FIG. 3 is a schematic diagram of a pattern.

As shown in FIG. 3, red sub-pixels R, green sub-pixels G, and blue sub-pixels B in shadow are sub-pixels at dark state, that is, the grayscale data voltages thereof are 0. Since zero grayscale data voltage causes relatively small VCOM shift, the influence thereof on the VCOM is ignored. The red sub-pixels R, the green sub-pixels G, and the blue sub-pixels B which are not in the shadow are sub-pixels at bright state. It is assumed here that the grayscale data voltage of each of the sub-pixels at bright state is 127.

As shown in FIG. 3, in an odd-numbered row of the sub-pixels, the number of the sub-pixels having high grayscale and positive polarity is twice the number of the sub-pixels having negative polarity. When the grayscale data voltages of odd-numbered rows are transmitted to the display panel, the VCOM voltage can be shifted upward. For the row of sub-pixels, the red sub-pixels R and the blue sub-pixels B become darker because the difference between the grayscale data voltages thereof and the VCOM voltage (namely, the relative voltage between the grayscale data voltage and the VCOM voltage) becomes smaller. The green sub-pixels G can become brighter because the difference between the grayscale data voltages thereof and the VCOM voltage becomes larger.

As shown in FIG. 3, in an even-numbered row of the sub-pixels, the number of the sub-pixels having high grayscale and negative polarity is twice the number of the sub-pixels having positive polarity. When the grayscale data voltages of even-numbered rows are inputted to the display panel, the VCOM voltage can be shifted downward. The polarities of each of the sub-pixels are opposite to those of the odd-numbered rows. As such, the red sub-pixels R and the blue sub-pixels B can become darker because the difference between the grayscale data voltages thereof and the VCOM voltage (ie, the relative voltage between the grayscale data voltage and the VCOM voltage) becomes smaller. The green sub-pixels G can become brighter because the difference between the grayscale data voltages and the VCOM voltage becomes larger.

Therefore, the overall image of FIG. 3 looks greenish.

In some embodiments of the present disclosure, the corresponding value of VCOM shift amplitude is calculated based on received grayscale data voltage signals of each row in a TCON. For example, the value of VCOM shift amplitude of the first row of sub-pixels is 5*127. The grayscale data voltage compensation value is obtained based on the value of VCOM shift amplitude. The specific grayscale data voltage compensation value may be obtained by first building a gray-scale data voltage compensation table inside TCON based on actual display conditions. The gray-scale data voltage compensation table stores mapping relationship between the values of VCOM shift amplitude and the grayscale data voltage compensation values.

In an existing TFT-LCD display driving method, a source driver transmits data of a row of pixels to a display panel at a falling edge of a TP signal. For every transmission of data of each row of pixels, the VCOM is shifted in sequence. Therefore, when the ICON compensates the grayscale data voltages, a row is considered as one unit. That is, the TCON is configured to calculate a value of VCOM shift amplitude based on data information of each row of pixels. A corresponding grayscale data voltage compensation value is selected based on the grayscale data voltage compensation table. Then, the compensated grayscale data voltages of the row of pixels are outputted to the source driver. Taking a Full High Definition (FHD has a resolution of 1920*1080) display screen as an example, there are +/−1920*3*255 groups of values of VCOM shift amplitude. In order to reduce the calculation amount of the TCON, the values of VCOM shift amplitude can be divided into a plurality of groups, and each group corresponds to a proper grayscale data voltage compensation value.

The compensation direction of pixels of positive and negative polarities is related to the shifting direction of the VCOM. Taking the first row of pixels in FIG. 3 as an example, VCOM is shifted up, the grayscale data voltages of the red sub-pixels R and those of the blue sub-pixels B become relatively small. That is, the compensation direction is positive. The grayscale data voltages of the green sub-pixels G become relatively large. That is, the compensation direction is negative.

Figure 4:
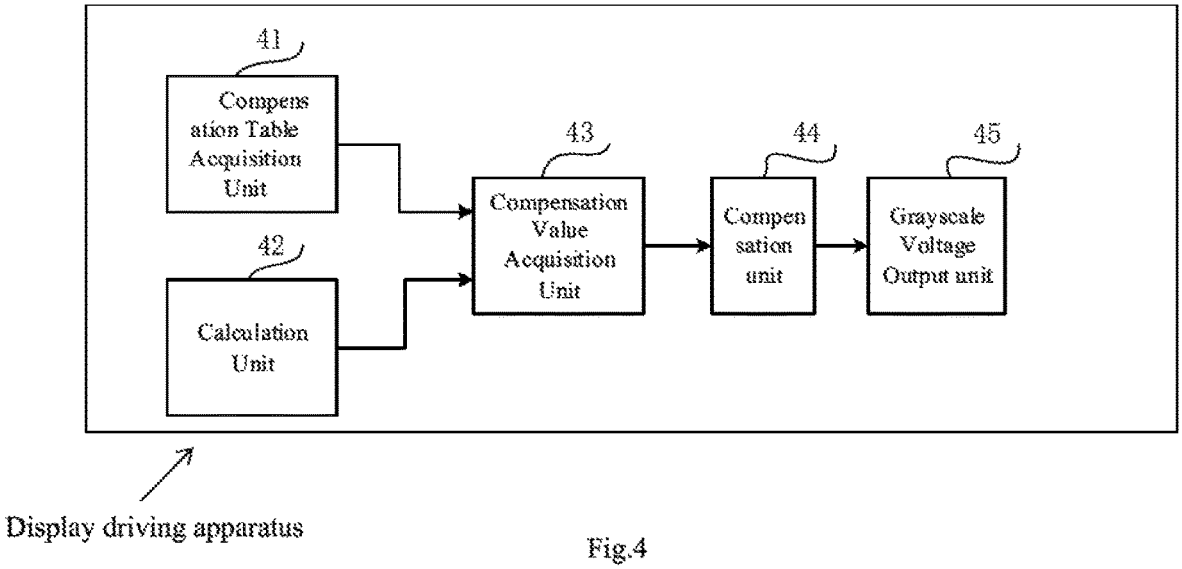
FIG. 4 is a structural diagram of a display driving apparatus according to some embodiments of the present disclosure.

A display driving apparatus is provided according to some embodiments of the present disclosure. As shown in FIG. 4, the display driving apparatus includes the following:

A compensation table acquirer 41 is provided according to some embodiments of the present disclosure. The compensation table acquirer 41 is configured to acquire a grayscale data voltage compensation table. The grayscale data voltage compensation table stores the mapping relationship between values of the VCOM shift amplitudes and the grayscale data voltage compensation values.

A calculator 42 is provided according to some embodiments of the present disclosure. The calculator 42 is configured to calculate a value of VCOM shift amplitude corresponding to a row of sub-pixels on the display panel based on the grayscale data voltages of a frame of image to be displayed.

A compensation value acquirer 43 is provided according to some embodiments of the present disclosure. The compensation value acquirer 43 is coupled to the compensation table acquirer 41 and the calculator 42. The compensation value acquirer 43 is configured to obtain a grayscale data voltage compensation value corresponding to a row of sub-pixels on the display panel based on the calculated value of VCOM shift amplitude and the grayscale data voltage compensation table.

A compensator 44 is provided according to some embodiments of the present disclosure. The compensator 44 is coupled to the compensation value acquirer 43. It is configured to compensate the grayscale data voltages actually inputted to the row of sub-pixels based on the grayscale data voltage compensation value to obtain compensated grayscale data voltages.

A grayscale data voltage outputer 45 is provided according to some embodiments of the present disclosure. The grayscale data voltage outputer 45 is coupled to the compensator 44. It is configured to output the compensated grayscale data voltages to the row of sub-pixels during display time of the frame of image to be displayed including the time period for providing the data voltages to the row of sub-pixels.

In the embodiments, the display driving apparatus calculates the value of VCOM shift amplitude corresponding to a row of sub-pixels on the display panel based on the grayscale data voltages of the frame of the image to be displayed, and compensate the grayscale data voltages based on the value of VCOM shift amplitude, thereby offsetting the VCOM shift. As such, the poor phenomena of color shift or the like caused by the VCOM shift are reduced.

In some embodiments, the calculator 42 includes a grayscale data voltage acquirer, a first calculator, a second calculator, and a third calculator.

The grayscale data voltage acquirer is configured to acquire a plurality of the grayscale data voltages respectively corresponding to a plurality of sub-pixels of a row of sub-pixels among the grayscale data voltages of the frame of image to be displayed. Each of the grayscale data voltages corresponds to a sub-pixel of the row of sub-pixels.

The first calculator is coupled to the grayscale data voltage acquirer. It is configured to add the grayscale data voltages of positive polarity among the plurality of grayscale data voltages to obtain a first shift value.

The second calculator is coupled to the grayscale data voltage acquirer. It is configured to add the absolute values of grayscale data voltages of negative polarity among the plurality of grayscale data voltages to obtain a second shift value.

The third calculator is coupled to the first calculator and the second calculator. It is configured to subtract the second shift value from the first shift value to obtain the value of VCOM shift amplitude.

In some embodiments, in the grayscale data voltages compensation table, a plurality of values of VCOM shift amplitude correspond to one grayscale data voltage compensation value. The difference between two values of VCOM shift amplitude corresponding to a same grayscale data voltage compensation value is smaller than a preset third value.

In some embodiments, the display driving apparatus further includes a compensation table checker.

The compensation table checker includes the following:

An initial acquirer is provided according to some embodiments of the present disclosure. The initial acquirer is configured to acquire an initial grayscale data voltage compensation table. The initial grayscale data voltage compensation table stores mapping relationship between values of initial VCOM shift amplitude and initial grayscale data voltage compensation values.

An initial compensator is provided according to some embodiments of the present disclosure. The initial compensator is coupled to the initial acquirer. It is configured to provide initial grayscale data voltages to a row of sub-pixels on the display panel, so that the value of VCOM shift amplitude corresponding to the row of sub-pixels is a value of initial VCOM shift amplitude. In addition, the grayscale data voltages actually inputted to the row of sub-pixels is compensated based on the initial grayscale data voltage compensation value to obtain the initial compensated grayscale data voltages. The initial compensated grayscale data voltages are outputted to the row of sub-pixels.

A compensation table detector is provided according to some embodiments of the present disclosure. The compensation table detector is respectively coupled to the initial acquirer and the compensation table acquirer 41. It is configured to detect the actual brightness value of each sub-pixel of the row of the sub-pixels, to adjust the initial grayscale data voltage compensation value based on the difference between the actual brightness value and the preset brightness value to obtain a grayscale data voltage compensation value corresponding to the value of initial VCOM shift amplitude. As such, the grayscale data voltage compensation table is obtained and transmitted to the compensation table acquirer. The preset brightness value is equal to the theoretical brightness value of the row of the sub-pixels when the initial grayscale data voltages are provided to each sub-pixel of the row of the sub-pixels.

In some embodiments, the grayscale data voltages inputted to the row of the sub-pixels include M grayscale data voltages. Each of the M grayscale data voltages corresponds to one sub-pixel in the row of the sub-pixels. M is an integer larger than 1.

In some embodiments, the compensator is specifically configured to control a grayscale data voltage actually inputted to one sub-pixel in the row of the sub-pixels to be equal to a sum of the original grayscale data voltage of the sub-pixel and the grayscale data voltage compensation value.

A display assembly is provided according to some embodiments of the present disclosure. The display assembly includes the display driving apparatus as mentioned above.

Specifically, the display assembly includes a TCON.

The compensation table acquirer, the calculator, the compensation value acquirer, the compensator, and the grayscale data voltage outputer are all arranged on the TCON.

The principles and the embodiments of the disclosures are set forth in the specification. The description of the embodiments of the present disclosure is only used to help understand the method of the present disclosure and the core idea thereof. Meanwhile, for a person of ordinary skill in the art, the disclosure relates to the scope of the disclosure, and the technical scheme is not limited to the specific combination of the technical features, and also should covered other technical schemes which are formed by combining the technical features or the equivalent features of the technical features without departing from the inventive concept. For example, technical scheme may be obtained by replacing the features described above as disclosed in this disclosure (but not limited to) with similar features.

What is claimed is:

1. A display driving method, comprising:

obtaining a grayscale data voltage compensation table, wherein the grayscale data voltage compensation table stores mapping relationship between voltages of common electrodes (VCOM) shift amplitudes and grayscale data voltage compensation values;

calculating a VCOM shift amplitude corresponding to a row of sub-pixels on a display panel based on grayscale data voltages of a frame of an image to be displayed;

obtaining a grayscale data voltage compensation value corresponding to the row of sub-pixels on the display panel based on the calculated VCOM shift amplitude and the grayscale data voltage compensation table;

compensating grayscale data voltages actually inputted to the row of sub-pixels based on the grayscale data voltage compensation value to obtain compensated grayscale data voltages; and outputting the compensated grayscale data voltages to the row of sub-pixels during a display time of the frame of the image to be displayed;

wherein calculating the VCOM shift amplitude corresponding to the row of sub-pixels on the display panel based on the grayscale data voltages of the frame of the image to be displayed comprises:

acquiring a plurality of grayscale data voltages respectively corresponding to a plurality of sub-pixels in the row of sub-pixels among grayscale data voltages of the frame of the image to be displayed, each of the plurality of the grayscale data voltages corresponding to a sub-pixel of the row of the sub-pixels;

obtaining a first shift value by adding the grayscale data voltages of a positive polarity among the plurality of grayscale data voltages respectively corresponding to the plurality of sub-pixels in the row of sub-pixels;

obtaining a second shift value by adding absolute values of the grayscale data voltages of a negative polarity among the plurality of grayscale data voltages respectively corresponding to the plurality of sub-pixels in the row of sub-pixels; and obtaining the VCOM shift amplitude by subtracting the second shift value from the first shift value.

2. The display driving method according to claim 1, wherein the display driving method further comprises, before obtaining the grayscale data voltage compensation table:

obtaining an initial grayscale data voltage compensation table, wherein the initial grayscale data voltage compensation table stores a mapping relationship between initial VCOM shift amplitudes and initial grayscale data voltage compensation values;

providing the initial grayscale data voltages to a row of sub-pixels on the display panel so that the VCOM shift amplitude corresponding to the row of the sub-pixels is an initial VCOM shift amplitude corresponding to the row of the sub-pixels;

compensating the grayscale data voltages actually inputted to the row of the sub-pixels based on an initial grayscale data voltage compensation value corresponding to the initial VCOM shift amplitude to obtain initial compensated grayscale data voltages;

outputting the initial compensated grayscale data voltages to the row of the sub-pixels;

measuring actual brightness values of the row of sub-pixels, and adjusting the initial compensated grayscale data voltages based on a difference between the actual brightness values and preset brightness values of the row of sub-pixels to obtain the grayscale data voltage compensation value corresponding to the initial VCOM shift amplitude, thereby obtaining the grayscale data voltage compensation table;

wherein the preset brightness values are theoretical values of brightness of the row of sub-pixels when the initial grayscale data voltages are provided to the row of the sub-pixels.

3. The display driving method according to claim 1, wherein the grayscale data voltages actually inputted to the row of sub-pixels comprise M grayscale data voltages, and each of the M grayscale data voltages corresponds to a sub-pixel in the row of the sub-pixels, and M is an integer larger than 1.

4. The display driving method according to claim 3, wherein compensating grayscale data voltages actually inputted to the row of sub-pixels based on the grayscale data voltage compensation value to obtain compensated grayscale data voltages comprises:

controlling a grayscale data voltage actually inputted to a sub-pixel of the row of sub-pixels to be equal to a sum of an original grayscale data voltage of the sub-pixel and the grayscale data voltage compensation value.

5. A display driving apparatus comprising:

a compensation table acquirer, which is configured to acquire a grayscale data voltage compensation table, wherein the grayscale data voltage compensation table stores mapping relationship between voltages of common electrodes (VCOM) shift amplitudes and grayscale data voltage compensation values;

a calculator, which is configured to calculate a VCOM shift amplitude corresponding to a row of sub-pixels on the display panel based on grayscale data voltages of a frame of image to be displayed;

a compensation value acquirer, which is coupled to the compensation table acquirer and the calculator and configured to obtain a grayscale data voltage compensation value corresponding to the row of sub-pixels on the display panel based on the calculated VCOM shift amplitude and the grayscale data voltage compensation table;

a compensator, which is coupled to the compensation value acquirer and configured to compensate the grayscale data voltages actually inputted to the row of sub-pixels based on the grayscale data voltage compensation value to obtain compensated grayscale data voltages; and a grayscale data voltage outputer, which is coupled to the compensator and configured to output the compensated grayscale data voltages to the row of sub-pixels during display time of the frame of image to be displayed;

wherein the calculator comprises:

a grayscale data voltage acquirer, which is configured to acquire a plurality of grayscale data voltages respectively corresponding to a plurality of sub-pixels of the row of sub-pixels among the grayscale data voltages of the frame of image to be displayed, each of the grayscale data voltages corresponding to a sub-pixel of the row of sub-pixels;

a first calculator, which is coupled to the grayscale data voltage acquirer and configured to add the grayscale data voltages of a positive polarity among the plurality of grayscale data voltages to obtain a first shift value;

a second calculator, which is coupled to the grayscale data voltage acquirer and configured to add absolute values of the grayscale data voltages of a negative polarity among the plurality of grayscale data voltages to obtain a second shift value; and a third calculator, which is coupled to the first calculator and the second calculator and configured to subtract the second shift value from the first shift value to obtain the VCOM shift amplitude.

6. The display driving apparatus according to claim 5, wherein the grayscale data voltages actually inputted to the row of sub-pixels comprise M grayscale data voltages, and each of the M grayscale data voltages corresponds to a sub-pixel in the row of the sub-pixels, and M is an integer larger than 1.

7. The display driving apparatus according to claim 6, wherein the compensator is configured to control a grayscale data voltage actually inputted to a sub-pixel of the row of sub-pixels to be equal to a sum of an original grayscale data voltage of the sub-pixel and the grayscale data voltage compensation value.

8. A display assembly comprising the display driving apparatus according to claim 5.

9. The display assembly according to claim 8, further comprising a time controller (TCON);

wherein the compensation table acquirer, the calculator, the compensation value acquirer, the compensator, and the grayscale data voltage outputer are all arranged on the TCON.

10. The display assembly according to claim 9, wherein the VCOM shift amplitudes are divided into a plurality of groups, and each of the plurality of groups corresponds to a grayscale data voltage compensation value.

11. A display driving apparatus comprising:

a compensation table acquirer, which is configured to acquire a grayscale data voltage compensation table, wherein the grayscale data voltage compensation table stores mapping relationship between voltages of common electrodes (VCOM) VCOM shift amplitudes and grayscale data voltage compensation values;

a calculator, which is configured to calculate a VCOM shift amplitude corresponding to a row of sub-pixels on the display panel based on grayscale data voltages of a frame of image to be displayed;

a compensation value acquirer, which is coupled to the compensation table acquirer and the calculator and configured to obtain a grayscale data voltage compensation value corresponding to the row of sub-pixels on the display panel based on the calculated VCOM shift amplitude and the grayscale data voltage compensation table;

a compensator, which is coupled to the compensation value acquirer and configured to compensate the grayscale data voltages actually inputted to the row of sub-pixels based on the grayscale data voltage compensation value to obtain compensated grayscale data voltages; and a grayscale data voltage outputer, which is coupled to the compensator and configured to output the compensated grayscale data voltages to the row of sub-pixels during display time of the frame of image to be displayed;

wherein the display driving apparatus further comprises a compensation table checker, the compensation table checker comprises:

an initial acquirer, configured to acquire an initial grayscale data voltage compensation table, wherein the initial grayscale data voltage compensation table stores mapping relationship between initial VCOM shift amplitudes and initial grayscale data voltage compensation values;

an initial compensator, coupled to the initial acquirer and configured to provide initial grayscale data voltages to a row of sub-pixels on a display panel so that the VCOM shift amplitude corresponding to the row of the sub-pixels is an initial VCOM shift amplitude corresponding to the row of the sub-pixels, to compensate the grayscale data voltages actually inputted to the row of the sub-pixels based on the initial grayscale data voltage compensation value corresponding to the initial VCOM shift amplitude to obtain the initial compensated grayscale data voltages; and to output the initial compensated grayscale data voltages to the row of the sub-pixels; and a compensation table detector, respectively coupled to the initial acquirer and the compensation table acquirer, and configured to measure actual brightness values of the row of sub-pixels and to adjust the initial compensated grayscale data voltages based on a difference between the actual brightness values and preset brightness values of the row of sub-pixels to obtain the grayscale data voltage compensation value corresponding to the initial VCOM shift amplitude, thereby obtaining the grayscale data voltage compensation table;

wherein the preset brightness values are theoretical values of brightness of the plurality of sub-pixels when the initial grayscale data voltages are provided to the row of the sub-pixels.

* * * * *